US006067961A

United States Patent [19]

Kato

[11] Patent Number: 6,067,961

[45] Date of Patent: May 30, 2000

[54] THROTTLE DEVICE FOR ENGINES HAVING SHAFT POSITIONING PART

[75] Inventor: Hideki Kato, Toyohashi, Japan

[73] Assignee: Denso Corporation, Japan

[21] Appl. No.: 09/176,103

[22] Filed: Oct. 21, 1998

[30] Foreign Application Priority Data

Oct. 30, 1997 [JP] Japan ..... 9-298615

[51] Int. Cl.[7] ..... F02D 1/00

[52] U.S. Cl. ..... 123/399; 251/305

[58] Field of Search ..... 123/399, 337; 251/305, 306

[56] References Cited

U.S. PATENT DOCUMENTS

| | | | |
|---|---|---|---|
| 4,895,343 | 1/1990 | Sato | 123/399 |
| 5,632,245 | 5/1997 | Ropertz | 123/337 |
| 5,687,691 | 11/1997 | Kaiser et al. | 123/337 |
| 5,868,114 | 2/1999 | Kamimura et al. | 123/399 |

FOREIGN PATENT DOCUMENTS

| | | |
|---|---|---|
| 64-24129 | 1/1989 | Japan . |
| 3-85334 | 4/1991 | Japan . |
| 6-117802 | 4/1994 | Japan . |
| 61-82043 | 5/1996 | Japan . |

*Primary Examiner*—John Kwon
*Attorney, Agent, or Firm*—Nixon & Vanderhye PC

[57] ABSTRACT

In a throttle device for automotive engines, a throttle shaft is position-regulated in the axial direction by a position regulating part of a throttle body at a side where a contact unit of a rotation position sensor is provided. Thus, the distance of axial movement of the contact unit is limited. Thus, the rotation position of the throttle shaft can be detected accurately by the rotation position sensor for the accurate control of the throttle valve opening angle, even when the surrounding temperature changes caused by heating of the engine and a throttle driving motor.

20 Claims, 2 Drawing Sheets

THROTTLE DEVICE FOR ENGINES HAVING SHAFT POSITIONING PART

CROSS REFERENCE TO RELATED APPLICATION

This application relates to and incorporates herein by reference Japanese Patent Application No. 9-298615 filed on Oct. 30, 1997.

BACKGROUND OF THE INVENTION

1. Field of the Invention

The present invention relates to a throttle device for engines, and more particularly to a throttle device which has a rotation position sensor for detecting an opening angle of a throttle valve.

2. Related Art

A conventional throttle device used for automotive engines has a throttle valve disposed in a throttle body forming an intake air passage. The throttle valve is fixed to a throttle shaft to rotate therewith for varying an opening area of the intake air passage, i.e., the amount of intake air supplied to the engine. In case the throttle valve is driven electrically by a motor, a rotation position sensor is used to detect an actual rotational position of the throttle valve for a throttle feedback control.

JP-A 6-117802 discloses a throttle device having a rotation position sensor. This sensor comprises a movable contact member fixed to a throttle shaft and a fixed resistor member held stationary relative to the throttle shaft, and are so arranged that the contact member driven by a throttle shaft slides over the resistor member in the circumferential direction to produce an electric voltage signal indicative of a throttle rotation position.

In the above throttle device, the throttle body is made of a material such as aluminum or resin for reducing weight, while the throttle shaft is made of such a material as iron for maintaining rigidity. The throttle device is used in the engine compartment and subjected to a large temperature change, e.g., heating and cooling of the engine and the throttle driving motor. The throttle shaft expands and contracts relative to the throttle body, because of the difference in the thermal expansion coefficients between the throttle body and the throttle shaft. The contact member of the rotation position sensor may thus change its position in the circumferential direction, sliding to a different position on the resistor member. This temperature-dependent position change causes the sensor to produce different detection outputs for the same rotation position of the throttle valve.

The throttle device may be used for an engine idle speed control, in which the throttle valve is maintained variably at a position close to the throttle full closure position. The above erroneous output from the sensor, particularly a sensor output indicating a larger throttle opening will angle than the actual opening, continue to drive the motor in the throttle closing direction even when the throttle valve is already at the full closure position. Thus, an excessive electric current continues to flow in a direction to close the throttle valve and damages the motor.

SUMMARY OF THE INVENTION

It is therefore an object of the present invention to provide a throttle device, which minimizes error in a rotation position detection of its rotation position sensor.

According to the present invention, a rotation position sensor and an electric motor are provided at one axial end side and the other axial end side of a throttle shaft, respectively, which rotates a throttle valve in a throttle body. A first bearing and a second bearing are provided near the one axial end side and the other axial end side, respectively, to support rotatably the throttle shaft. A biasing member is disposed near the second bearing to bias the throttle shaft in a direction toward the motor through the second bearing. The throttle body has a positioning part such as a wall at a position adjacent to the first bearing to restrict the first bearing from moving away from the rotation position sensor.

Preferably, the first bearing has an outer ring fitted in the throttle body movably in the axial direction, an inner ring fitted on the throttle shaft movably in the axial direction, and balls fitted between the outer ring and the inner ring. An annular groove is formed on the position regulating wall to allow the inner ring to move axially more than the outer ring.

The second bearing also has an outer ring, an inner ring, and balls. The biasing member is disposed to bias the outer ring thereby to bias the throttle shaft through the balls and the inner ring.

BRIEF DESCRIPTION OF THE DRAWINGS

Other objects, features and advantages of the present invention will become more apparent from the following detailed description made with reference to the accompanying drawings. In the drawings.

DETAILED DESCRIPTION OF THE PREFERRED EMBODIMENT

Figure 1:
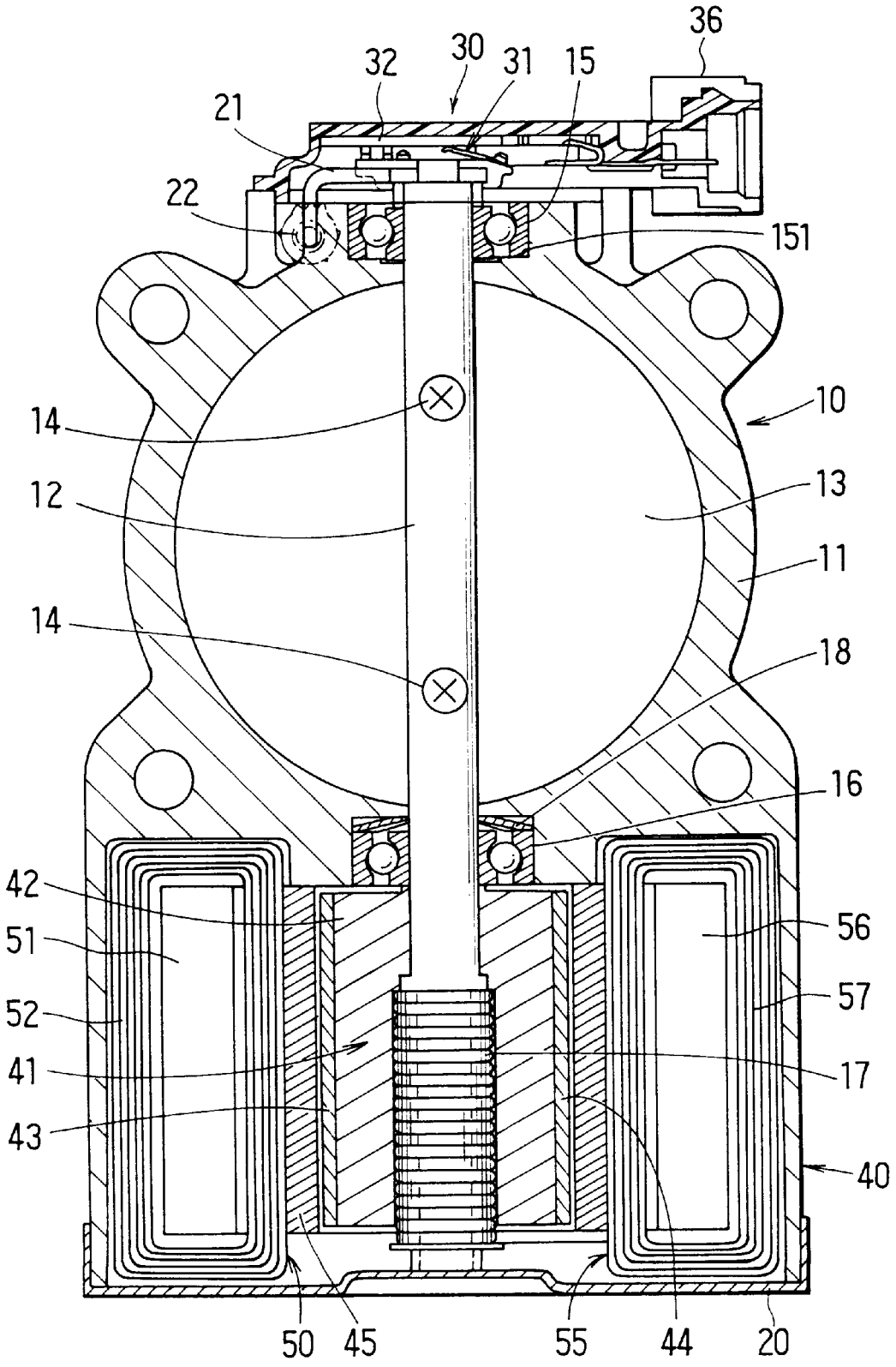
FIG. 1 is a sectional view showing a throttle device for engines according to an embodiment of the present invention.

Referring to FIG. 1, a throttle device 10 has a cylindrical throttle body 10, a rotation position sensor 30 and a torque motor 40 as an actuator. The throttle body 10 supports rotatably a throttle shaft 12 to which a throttle valve 13 is fixed. In this embodiment, the throttle valve 13 is not linked with an accelerator pedal (not shown) mechanically, but coupled with the torque motor 40 to be driven thereby.

The throttle body 11 of the throttle device 10 is made of a light weight material such as aluminum or resin. The throttle body 11 supports the throttle shaft 12 rotatably by bearings 15, 16 provided respectively at one axial end side and the other axial end side of the throttle shaft 12. A wavy washer 18 is provided at the side of the bearing 16 to bias the throttle shaft 12 toward the torque motor 40. The bearing 15 abuts a positioning part 151 thereby to hold the throttle shaft 12 in position with respect to the axial direction. Though the throttle shaft 12 should be made of a rigid material such as iron, it is desirable that the throttle shaft 12 is made of a material such as SUS 304 which has a thermal expansion coefficient which is closer to that of aluminum or resin than that of iron.

Figure 2:
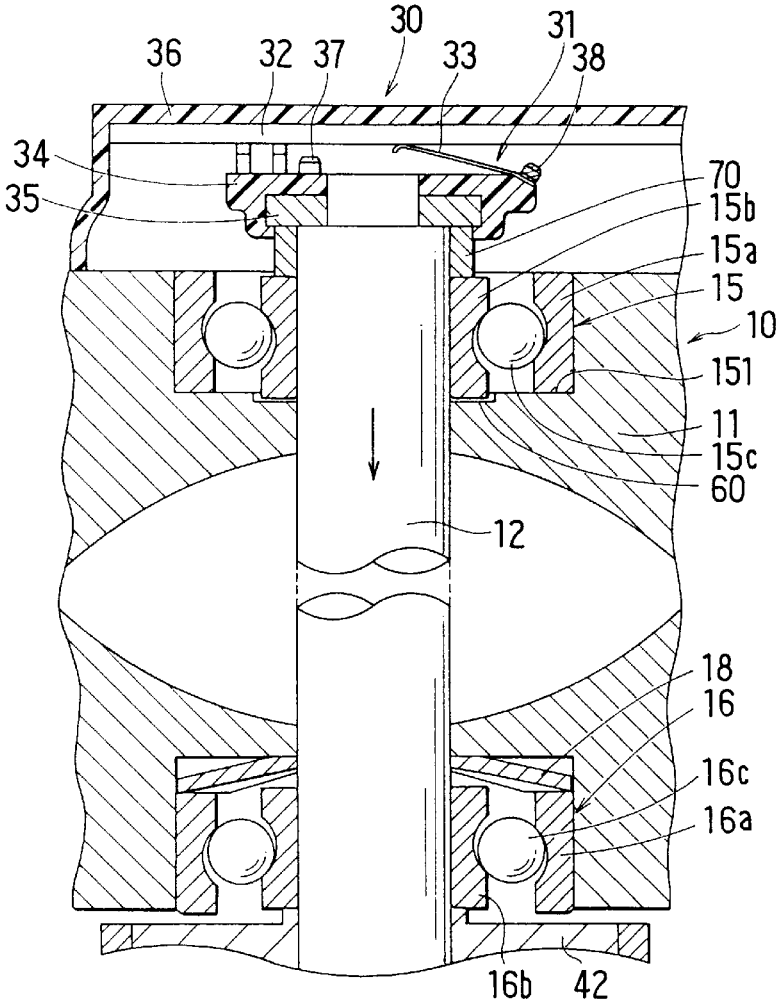
FIG. 2 is an enlarged sectional view showing bearings used in the throttle device shown in FIG. 1.

As shown in more detail in FIG. 2, an outer ring 15*a* of the bearing 15 is fitted in the throttle body 11 movably in the axial direction. An inner ring 15*b* of the bearing 15 is fitted around the throttle shaft 12 movably in the axial direction. A wall of the throttle body 11 opposing the axial end of the outer ring 15*a* provides the positioning part 151.

An annular groove 60 is formed on the positioning wall of the throttle body 11 opposing the axial end of the inner ring

15*b* to allow the axial movement of the inner ring 15. The groove 60 has a depth in the axial direction, which is larger than the distance of possible axial movement of the inner ring 15*b*.

An annular collar 70 is fitted around the throttle shaft 12 at a side opposite to the annular groove 60. A movable contact unit 31 of the rotation position sensor 30 is fixed to the throttle shaft 12 by a screw 37. The collar 70 abuts at one end thereof the movable contact unit 31 by the biasing force of the wavy washer 18 and abuts at the other end thereof the inner ring 15*b* of the bearing 15, thus regulating the axial movement of the inner ring 15*b*.

An outer ring 16*a* of the bearing 16 is fitted in the throttle body 11 movably in the axial direction. An inner ring 16*b* of the bearing 16 is fitted around the throttle shaft 12 movably in the axial direction. A radially outer end of the wavy washer 18 disposed between the bearing 16 and the throttle body 11 engages with the axial end of the outer ring 16*a*. A radially inner end of the wavy washer 18 engages with a wall of the throttle body 11 opposing the axial end of the bearing 16. Thus, as shown by an arrow in FIG. 2, the outer ring 16*a* is biased in one axial direction, i.e., toward the torque motor 40 which is positioned oppositely to the rotation position sensor 30 with respect to the axial direction.

The torque motor 40 is provided adjacent to the axial end of the bearing 16 at a position opposite to the wavy washer 18. The inner ring 16*b* is held in abutment with a rotor core 42 of the torque motor 40 by the biasing force of the wavy washer 18.

In the above construction, the wavy washer 18 biases the outer ring 16*a* in the arrow direction in FIG. 2. The inner ring 16*b*, being pulled by the outer ring 16*a* through balls 16*c*, is also biased in the same direction to abut the rotor core 42. Thus, the throttle shaft 12 fixed to the rotor core 42 is also biased in the arrow direction.

The contact unit 31 fixed to the throttle shaft 12 is pulled in the arrow direction to abut the axial end of the collar 70. The collar 70, abutting the inner ring 15*b*, pushes the same in the arrow direction. The outer ring 15*a*, being coupled with the inner ring 15*b* through balls 15*c*, is pulled by the inner ring 15*b* to abut the positioning part 151 of the throttle body 11. Thus, the throttle shaft 12 is regulated in position by the positioning part 151 with respect to its axial direction. The inner ring 15*b* is not restricted by the throttle body 11 from moving axially, owing to the annular groove 60.

The throttle valve 13 is made of brass and in a disk shape. It is fixed to the throttle shaft 12 by screws 14 under a position-regulated state. The throttle valve 13 rotates with the throttle shaft 12 to vary an intake air flow area of an intake air passage defined by the inner wall surface of the throttle body 11.

Figure 3:
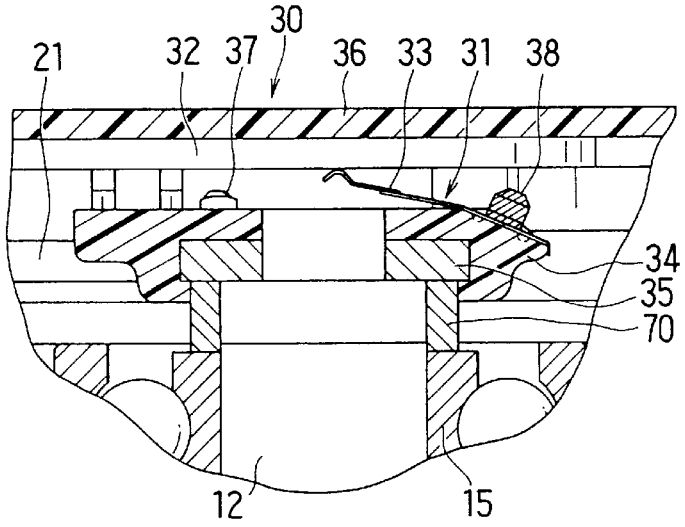
FIG. 3 is an enlarged sectional view showing a rotation position sensor used in the throttle device shown in FIG. 1.

The throttle shaft 12 fixedly supports at its one end a throttle lever 21, which is provided integrally with a metal plate 35 as shown in FIG. 3. A stopper screw 22 is provided to abut the throttle lever 21, thus defining a full closure position of the throttle valve 13. The full closure position of the throttle valve 13 is adjustable by the threaded position of the stopper screw 22.

As shown in FIG. 1, the rotation position sensor 30 is disposed fixedly at a position closer to the axial end of the throttle shaft 12 than a throttle lever 21 is. Further as shown in detail in FIG. 3, it comprises the contact unit 31, a substrate 32 formed with a resistor in a film form and a resin housing 36 which fixedly supports the substrate 32 therein.

The contact unit 31 has a disk-shaped resin plate 34 and a metal plate 35 molded with the resin plate 34. The movable contact 33 is made of a resilient metal piece, and its one end is attached to the outer peripheral part of the resin plate 34 by a screw so that its other end slides on the resistor of the substrate 32. The resin plate 34 and the metal plate 35 have respective central through holes into which the axial end side of the throttle shaft 12 is press-fitted. Thus, the contact unit 31 is fixed to the throttle shaft 12 for rotation with the throttle shaft 12. The collar 70 is held in contact with the metal plate 35 of the contact unit 31, so that the collar 70 may not bite into the resin plate 34. Thus, the position regulation of the inner ring 15*b* is assured.

A constant voltage (e.g., 5V) is applied to the resistor on the substrate 32, and the contact 33 slides on the resistor in response to the rotary movement of the throttle shaft 12 and the throttle valve 13. Thus, the sensor 30 produces an electric voltage signal varying with the rotary position of the throttle valve 13 to indicate the throttle opening angle.

The torque motor 40 is disposed at the position opposite to the rotation position sensor 30 in the axial direction. It comprises a rotor 41, a stator core 45, and a pair of solenoid units 50, 55 mounted on the stator core 45. A cover 20 closes an axial side end of the torque motor 40.

The rotor 41 comprises the rotor core 42 press-fitted on the throttle shaft 12, and a pair of permanent magnets 43, 44 provided on the rotor core 42 oppositely to each other in the radial direction with respect to the throttle shaft 12, that is, the rotary axis of the rotor 40. The permanent magnets 43, 44 have a plurality of plate-shaped permanent magnets 43*a*, 44*a* are positioned 180° apart from each other.

Each magnet 43*a*, 44*a* is magnetized in the radial direction of the rotor 41 and arranged so that one of the magnets 43, 44 provides N-pole at its radially outermost peripheral surface while the other of the magnets 43, 44 provides S-pole at its radially outermost peripheral surface. Thus, the magnets 43, 44 provide one N-pole and one S-pole on the radially opposing peripheral surfaces of the rotor 41. It is desired that each magnet is made of magnetic material in the rare-earth salt such as neodymium system material or samarium-cobalt system material which generates high magnetism. However, other magnetic materials such as ferrite system material may also be used.

The stator core 45 and solenoid units 50, 55 form a stator. The stator core 45 has a central through hole which accommodates the rotor 41 therein. The solenoid units 50, 55 are mounted on the stator core 45 to magnetize the same. The stator core 45 is formed by stacking a plurality of thin magnetic steel plates in the radial direction and disposed to oppose each other, thus providing the hollow space (central through hole) therebetween. The hollow space accommodates the rotor 41 therein rotatably.

The solenoid unit 50 comprises an iron core 51 and a solenoid coil 52 wound around the core 51, while the solenoid unit 55 comprises an iron core 56 and a solenoid coil 57 wound around the iron core 56. The solenoid units 50 and 55 are displaced by 180° in the circumferential direction to face each other in the radial direction. A return spring 17 has one end fixed to the rotor core 42 and the other end fixed to the throttle body 11, thereby biasing normally the throttle valve 13 in a throttle closing direction.

With the solenoid coils 52, 57 being energized electrically, the stator cores 45, 46 generate the magnetic pole pair of N-pole and S-pole. The magnetic pole pairs of the rotor 41 and the stator core 45, which attract and repel alternately, generate a torque to rotate the rotor 41 against the biasing force of the return spring 17.

The throttle device 10 operates as follows.

In vehicle running including an idling mode, a normal mode and an automatic cruising mode, a desired opening angle of the throttle valve 13 is calculated by an electronic controller (not shown) based on engine operating conditions such as an accelerator depression position and an engine rotational speed. A control current is supplied to the solenoid coils 52, 57 in accordance with the calculated desired opening angle. With the torque generated when the solenoid coils 52, 57 are thus energized, the rotor 41 rotates against the biasing force of the return spring 17.

The throttle valve 13 also rotates with the rotor 41 to open. The throttle rotation position or throttle opening angle is detected by the rotation position sensor 30 and is fed back to the electronic controller. The controller thus feedback controls the throttle rotation position by varying the control current supplied to the solenoid coils 52, 57.

The throttle device 10 used in an engine compartment is subjected to a large temperature change, i.e., heating and cooling of the engine and the torque motor 40. The throttle shaft 12 expands and contracts in the axial direction relative to the throttle body 11, because of difference in the thermal expansion coefficients among the throttle body 11, the throttle shaft 12, the resin housing 36 and the like. However, because the throttle shaft 12 is position-regulated at the side the contact unit 31 of the rotation position sensor 30 is disposed, the relative variation in the axial length of the throttle shaft 12 toward the contact unit 31 is limited to the variation from the positioning part 151. Specifically, because the length of the throttle shaft 12 between the positioning part 151 and the contact unit 31 is short enough, its variation in the axial direction is also small. Thus, the distance of axial movement of the contact unit 31 is limited. As a result, the change in the circumferential position of the contact 33 caused by the change in the axial length of the throttle shaft 12 is reduced to a minimum, thereby reducing an error in the position detection output of the rotation position sensor 30.

This distance is limited further by constructing the throttle shaft 12 by a material such as SUS 304 which has the thermal expansion coefficient close to that of the throttle body 11. Thus, the rotation position of the throttle shaft 12, i.e., the opening angle of the throttle valve 13, can be detected accurately by the rotation position sensor 30 for the accurate control of the throttle valve opening angle, even when the surrounding temperature changes. It is of particular advantage that damaging the motor 40 by the continued supply of excessive current in the throttle closing direction in spite of the stopped condition of the throttle valve 13, which is likely to occur during the idling speed control, can be obviated. It is also of advantage that consuming too much fuel because of excessive current in the throttle opening direction can be obviated.

The above embodiment may be modified in various ways. For instance, the rotor 41 may be driven only by the electromagnetic force in both directions without using the return spring 17, which normally biases the rotor 41 in the throttle closing direction. The inner rings 15*b*, 16*b* of the bearings 15, 16 may be press-fitted on the throttle shaft 12 without allowing movement in the axial direction. The wavy washer 18 may be disposed to bias the inner ring 16*b* of the bearing 16. Further, the motor 40 may be disposed at the same side as the sensor 30, as long as sensor output variations caused by the heat generation in the motor 40 is tolerable. For instance, the shaft 12 may be extended through the substrate 32 and the housing 36 rotatably so that the motor 40 may be attached to the extended part of the shaft 12.

Other modifications and changes are also possible without departing from the spirit and scope of the invention.

What is claimed is:

1. A throttle device comprising:

a throttle body having an air passage therein;

a throttle shaft supported rotatably by the throttle body;

a throttle valve fixed to the throttle shaft to vary an air flow amount in the air passage;

a sensor provided at one axial end side of the throttle shaft to detect a rotation position of the throttle shaft;

a biasing member disposed to bias the throttle shaft in a direction opposite to the sensor; and a positioning part provided near the one axial end side to regulate an axial position of the throttle shaft.

2. The throttle device as in claim 1, wherein:

the sensor has a movable contact fixed to the one axial end side of the throttle shaft.

3. The throttle device as in claim 1, further comprising:

a motor having a rotor fixed to another axial end side of the throttle shaft to drive the throttle shaft.

4. The throttle device as in claim 1, further comprising:

a first bearing disposed between the throttle body and the throttle shaft near the one axial end side of the throttle shaft; and a second bearing disposed between the throttle body and the throttle shaft near the another axial end side of the throttle shaft.

5. The throttle device as in claim 4, wherein:

the throttle body has a wall, as the positioning part, near the one axial end side of the throttle shaft to restrict an axial movement of the first bearing.

6. The throttle device as in claim 5, wherein:

the first bearing includes an outer ring fitted in the throttle body movably in the axial direction at a position axially adjacent to the wall of the throttle body, an inner ring fitted around the throttle shaft movably in the axial direction, and balls disposed between the outer ring and the inner ring.

7. The throttle device as in claim 6, wherein:

the wall of the throttle body has an annular groove to allow the inner ring to move more in the axial direction than the outer ring.

8. The throttle device as in claim 7, further comprising:

a collar fitted on the throttle shaft at a position between the inner ring and the sensor to move the inner ring together with the throttle shaft.

9. The throttle device as in claim 4, wherein:

the second bearing includes an outer ring fitted in the throttle body movably in the axial direction, an inner ring fitted around the throttle shaft movably in the axial direction, and balls disposed between the outer ring and the inner ring.

10. The throttle device as in claim 9, wherein:

the biasing member has one end engaging the throttle body and another end engaging the outer ring to bias the outer ring in the direction opposite to the sensor.

11. A throttle device comprising:

a throttle body having an air passage therein;

a throttle shaft rotatably supported by the throttle body;

a throttle valve fixed to the throttle shaft;

a sensor coupled to the throttle shaft to detect a rotation position of the throttle shaft;

a biasing member disposed to bias the throttle shaft in one axial direction; and a position regulating part provided adjacent the sensor to restrict the throttle shaft from moving in the one direction, thereby regulating an axial position of the throttle shaft.

12. The throttle device as in claim 11, further comprising:

a bearing fitted around the throttle shaft and supported in the throttle body near the sensor, wherein the throttle body has a recess to hold the bearing therein, and a wall defining an axial end of the recess that is abutted by the bearing to restrict movement of the bearing in said one axial direction, thereby comprising the position regulating member.

13. The throttle device as in claim 12, wherein:

the bearing includes an inner ring fitted around the throttle shaft, an outer ring fitted in the recess to surround the inner ring and held in abutment with the wall, and balls disposed between the inner ring and the outer ring; and an annular groove is defined in said wall at a radial position corresponding to a position of the inner ring so that the inner ring is movable in said one axial direction into the annular groove.

14. The throttle device as in claim 11, further comprising:

a first bearing fitted around one axial end portion of the throttle shaft and supported in the throttle body; and a second bearing fitted around another axial end portion of the throttle shaft and supported in the throttle body, wherein the sensor is coupled to the one axial end portion of the throttle shaft, and the position regulating part is provided to abut the first bearing thereby restricting a movement of the first bearing in the one axial direction.

15. The throttle device as in claim 14, further comprising:

an electric motor coupled to another axial end portion of the throttle shaft to rotate the throttle shaft, wherein the biasing member is disposed between the throttle body and the second bearing so that the throttle shaft is biased toward the electric motor through the second bearing.

16. A throttle valve assembly comprising:

a throttle body having an air passage defined therein;

a throttle shaft mounted in said throttle body so as to be rotatable about a longitudinal axis thereof, said throttle shaft having first and second axial ends;

a sensor disposed in said throttle body at said first axial end of said throttle shaft;

a biasing member disposed in said throttle body for biasing the throttle shaft in one axial direction, away from said sensor; and a position regulating part provided adjacent said sensor for restricting axial movement of the throttle shaft in said one axial direction, thereby to regulate an axial position of the throttle shaft.

17. The throttle device of claim 16, further comprising:

a first bearing assembly mounted proximate said first axial end of said throttle shaft, said first bearing including an outer ring supported in the throttle body, an inner ring fitted on the throttle shaft, and balls fitted between said outer ring and said inner ring;

a second bearing assembly mounted proximate said second axial end of the throttle shaft;

said second bearing including an outer ring supported in the throttle body, an inner ring fitted on the throttle shaft, and balls fitted between said outer ring and said inner ring.

18. The throttle device as in claim 17, wherein said position regulating part comprises a recess defined in the throttle body for receiving said first bearing therein and a wall defined an axial end of said recess for abutting at least a portion of said first bearing to restrict movement of said first bearing in said one axial direction.

19. The throttle device as in claim 18, wherein an annular groove is defined in said wall at a radial position corresponding to a position of said inner ring of said first bearing, whereby said inner ring is movable in said one axial direction into said annular groove.

20. The throttle device as in claim 19, wherein a component of said sensor is coupled to said first axial end of said throttle shaft and an electric motor is operatively coupled to said second axial end of the throttle shaft for rotating said throttle shaft, and wherein said biasing member is disposed between said throttle body and said outer ring of said second bearing for biasing said throttle shaft toward said electric motor.

* * * * *